US008511848B2

(12) United States Patent
Gantenbrink

(10) Patent No.: US 8,511,848 B2
(45) Date of Patent: Aug. 20, 2013

(54) LUMINAIRE

(75) Inventor: Heinrich Johannes Gantenbrink, Menden (DE)

(73) Assignee: Bega Gantenbrink-Leuchten KG, Menden (DE)

( * ) Notice: Subject to any disclaimer, the term of this patent is extended or adjusted under 35 U.S.C. 154(b) by 212 days.

(21) Appl. No.: 13/054,497

(22) PCT Filed: Apr. 16, 2009

(86) PCT No.: PCT/EP2009/002799
§ 371 (c)(1),
(2), (4) Date: Jan. 16, 2011

(87) PCT Pub. No.: WO2010/006665
PCT Pub. Date: Jan. 21, 2010

(65) Prior Publication Data

US 2011/0122618 A1 May 26, 2011

(30) Foreign Application Priority Data

Jul. 17, 2008 (DE) ..... 10 2008 033 533

(51) Int. Cl.
*F21V 21/00* (2006.01)

(52) U.S. Cl.
USPC ..... 362/217.07; 362/347

(58) Field of Classification Search
USPC ..... 362/219, 217.05, 217.07, 236–238, 362/240–243, 298, 346, 347, 249.02, 612
See application file for complete search history.

(56) References Cited

U.S. PATENT DOCUMENTS

| | | | | |
|---|---|---|---|---|
| 6,318,886 | B1 | 11/2001 | Stopa et al. | |
| 6,641,282 | B2 * | 11/2003 | Perlo et al. | 362/217.06 |
| 6,784,357 | B1 | 8/2004 | Wang | |
| 7,350,955 | B2 * | 4/2008 | Chang et al. | 362/612 |
| 2005/0111220 | A1 | 5/2005 | Smith | |
| 2005/0128744 | A1 * | 6/2005 | You et al. | 362/241 |
| 2006/0002101 | A1 * | 1/2006 | Wheatley et al. | 362/84 |
| 2006/0007013 | A1 * | 1/2006 | Singer et al. | 340/815.45 |
| 2007/0103894 | A1 | 5/2007 | Klose | |
| 2007/0171626 | A1 * | 7/2007 | Chang | 362/97 |
| 2007/0217192 | A1 * | 9/2007 | Hiratsuka | 362/241 |
| 2007/0297192 | A1 * | 12/2007 | Kanade et al. | 362/609 |
| 2010/0097797 | A1 * | 4/2010 | Chen et al. | 362/234 |

FOREIGN PATENT DOCUMENTS

| | | | |
|---|---|---|---|
| DE | 202 04 352 | U1 | 6/2002 |
| EP | 1 431 653 | A2 | 6/2004 |
| EP | 1 557 604 | A1 | 7/2005 |
| EP | 1 571 391 | A2 | 9/2005 |
| WO | 2007/106411 | A2 | 9/2007 |

* cited by examiner

*Primary Examiner* — Julie Shallenberger
(74) *Attorney, Agent, or Firm* — Baker & Hostetler LLP

(57) ABSTRACT

A luminaire including a plurality of light-emitting light sources is provided. The luminaire can be produced with little manufacturing out-lay and, consequently, economically, which is suited for street and path lighting and reduces the glare for an observer. The luminaire comprises at least one reflector profile extending in the longitudinal direction and comprising a plurality of apertures and at least one reflector surface provided on the front of the reflector profile, the light sources being arranged in the area of the apertures at the back of the reflector profile. A reflector profile for a luminaire is also provided.

10 Claims, 8 Drawing Sheets

LUMINAIRE

CROSS-REFERENCE TO RELATED APPLICATIONS

This application is a National Stage of International Patent Application No. PCT/EP2009/002799, filed on Apr. 16, 2009, which claims priority to foreign Patent Application No. DE 10 2008 033 533.9, filed on Jul. 17, 2008, the contents of which are incorporated herein by reference in their entirety.

FIELD OF INVENTION

The present invention relates to a luminaire comprising a plurality of light-emitting light sources.

BACKGROUND OF THE INVENTION

Light-emitting diodes (LEDs) have already been used for quite some time as light sources in luminaires. Light-emitting diodes are distinguished by low power consumption and a long service life. Meanwhile, it has also become known to use light-emitting diodes in street lightings. For this purpose, individual light-emitting diodes or groups of light-emitting diodes can be used. For influencing the emission characteristics of the light-emitting diodes, the latter are normally equipped with light-directing means of a transparent nature. Collimators, ancillary lenses, diffusion disks or the like may, for example, be used for this purpose. The light-directing means have the effect that the light generated in the light-emitting diode is concentrated in one spatial direction. In addition, the light beam has imparted thereto a specific distribution. Examples for such distributions are e.g. a concentrating distribution, a scattering distribution or a banded distribution. Due to the light-directing ancillary unit, each light-emitting diode or each group of light-emitting diodes becomes a very small spotlight with special light-technical characteristics. The emission directions of the individual light-emitting diodes or of the groups of light-emitting diodes are determined by tilting the light-emitting diode or the group of light-emitting diodes and by their positioning in the luminaire housing of the street lighting. The light-emitting diodes or groups of light-emitting diodes are directly oriented onto the target surface, e.g. onto the surface of a carriageway. Individual light-emitting diodes or groups of light-emitting diodes irradiate light onto different points of the target surface. Due to the superimposition of the individual light emissions of the light-emitting diodes or of the groups of light-emitting diodes, the desired luminosity distribution is achieved on the target surface.

This arrangement of light-emitting diodes in a street lighting is, on the one hand, disadvantageous insofar as the light-emitting diodes illuminate the target surface directly and are therefore also directly visible. The very small dimensions and high luminous fluxes of the individual light-emitting diodes lead to very high luminous densities on the surfaces of the light-emitting diodes or on the ancillary optics of the light-emitting diodes. This leads to a strong glare for an observer.

Since the light-emitting diodes or the groups of light-emitting diodes are individually oriented onto points of the target surface, a very complex geometry of the mechanical structure of the luminaire is required. In addition, the light-emitting diodes must be wired and mounted individually or in several groups. This results in a high manufacturing outlay and therefore also in high costs of the overall system. Hence, also the repair of the light-emitting diode unit entails great effort and high costs.

Another drawback is to be seen in the collimators which are frequently used for concentrating the light of the light-emitting diodes. The collimators have a comparatively low efficiency amounting in some cases only to approx. 75%. Street lightings having the above-described structural design are therefore often inefficient. Another drawback is to be seen in the fact that most collimators operate on the basis of the principle that the light emitted by the light-emitting diode is totally reflected by the circumferential surface of the collimators. If water droplets or condensed moisture adheres to the circumferential of surface the collimators, the collimators will be rendered ineffective. Hence, street lightings in which the ancillary optics of the light-emitting diodes consist of collimators tend to be failure prone in the case of an ingress of moisture.

In addition, it is also known to use so-called light-emitting diode clusters (LED clusters) as a light source in street lightings. LED clusters consist of individual light-emitting diodes which are combined so as to form a homogeneous group of light-emitting diodes. The light-emitting diodes are often arranged in common on a conductor board. Most of the ray beams of the individual light-emitting diodes therefore have the same direction, so that the LED cluster can be seen as a single light source and can therefore also be compared with a conventional light source. The light emitted by the whole LED cluster is then conducted through ancillary optics. For example, the cover glass of the street lighting may be configured as ancillary optics. It is possible to produce the cover glass from moulded glass having incorporated therein light-directing structures, e.g. lens-shaped or prismatic elements.

A street lighting of this kind is, on the one hand, disadvantageous insofar as it will normally not be possible to generate the ideal-typical luminosity distributions of a street lighting. The distributions generated are, however, those known from the field of headlight construction and automotive engineering. If the light-directing structure is configured as a prismatic structure, a banded distribution will normally be accomplished. This variant is not very desirable for use as street lighting. In addition, the efficiency of such a system must be considered rather low.

SUMMARY OF THE INVENTION

It is therefore the object of the present invention to provide a luminaire which can be produced economically, which is suited for street and path lighting and avoids the drawbacks of the prior art. In particular, manufacturing is to be simplified and the glare for an observer is to be avoided.

To this end, the present invention is so conceived that the luminaire comprises at least one reflector profile extending in the longitudinal direction and comprising a plurality of apertures and at least one reflector surface provided on the front of the reflector profile, the light sources being arranged in the area of the apertures at the back of the reflector profile.

It is true that the use of reflectors is already common practice in the case of conventional street lightings, but such street lightings normally have arranged therein only a light source radiating light as a point in the interior of the reflector. At least a part of the light emitted by the light source radiating light as a point directly irradiates the surface to be illuminated. Since the light source is arranged within the reflector, major parts of the reflector must have a complex three-dimensional geometry.

In view of the fact that the light sources of the luminaire according to the present invention are arranged at the back of the reflector profile at the apertures, i.e. within or behind the apertures of the at least one reflector profile, the light emitted by the light sources is not irradiated directly onto the surface to be illuminated but onto the associated reflector surface, where it is redirected onto the surface to be illuminated. It follows that the luminaire irradiates indirect light so that a glare for the observer will be avoided. Since the light sources are arranged at the back of the reflector profile, the light sources can be fixed easily. A reflector profile extending in the longitudinal direction means here a reflector profile that is linear in the longitudinal direction, e.g. for a linear fluorescent luminaire, as well as a reflector profile that is curved in the longitudinal direction, e.g. a circular reflector profile having a large radius.

An advantageous embodiment can be so conceived that a plurality of light sources are combined so as to form a light source module, and that the back of the reflector profile is provided with at least one connection surface having arranged thereon the light source module. The light sources are preferably implemented as light-emitting diodes and arranged on a common board. This allows very easy mounting of the light source module, e.g. of the board having the light-emitting diodes arranged thereon. The outlay for manufacturing the luminaire is reduced in this way and the luminaire becomes less expensive. In addition, the structural complexity of the luminaire is reduced.

Another preferred embodiment can be so conceived that the apertures provided in the reflector profile are implemented as reflectors and provided with a reflecting circumferential surface. Hence, each individual light source or each individual light-emitting diode has a small reflector of its own, by means of which the light of the light source is concentrated onto the associated, normally oppositely disposed, reflector surface. The light emitted by the light sources is deflected by the contour of the light-directing reflector surfaces in the desired direction in the vertical viewing plane.

In order to adjust the desired luminous flux concentration and the desired luminosity distribution, the apertures can be conical or parabolic in shape. The apertures can be produced e.g. by drilling, e.g. with a conical drill or a profile drill. Instead of drilling, also profile milling may be executed, whereby more complex luminosity distributions of the individual light sources can be generated.

According to yet another embodiment, a centre axis of at least one aperture can extend parallel to a centre axis of the light source associated with said aperture. When the light source used is a light-emitting diode or a light-emitting diode module, the centre axis of the light source corresponds to the surface normal on the board of the light-emitting diodes. The aperture will then have the shape of a right circular cone. Since the light source is normally arranged centrally within the aperture, the centre axis of the aperture will then also extend perpendicularly to the connection surface of the reflector profile. By means of this kind of arrangement, a concentrating, symmetric beam path is accomplished.

If an asymmetric, tilted beam path is to be generated, it can be provided that a centre axis of at least one aperture defines an angle with a centre axis of the light source associated with said aperture, so that the centre axis of the aperture is inclined in the longitudinal direction of and/or transversely to the longitudinal direction of the reflector profile. The aperture then has the shape of an oblique circular cone. The centre axis of the aperture is inclined relative to the connection surface of the reflector profile and defines an angle of less than 90° therewith. It follows that the light source or light-emitting diode need not be tilted or provided with ancillary optics for generating an asymmetric beam path. This is important especially for street lightings, since street lightings are normally installed on the roadside or wayside and should therefore have an asymmetric luminosity distribution in the horizontal viewing plane.

Another variant is so conceived that the cross-section of the reflector surface at right angles to the longitudinal axis of the reflector profile is defined by a continuous curve. The reflector profile is therefore easy to manufacture, the desired visual appearance and illumination are accomplished.

It may, however, also be provided that the cross-section of the reflector surface at right angles to the longitudinal axis of the reflector profile is defined by a plurality of adjoining curve segments. As regards its cross-section, the reflector surface is then advantageously configured as a Fresnel structure. The reflector surface is thus comparatively planar.

According to yet another embodiment, it can be provided that the luminaire comprises at least one additional reflector profile, the reflector profiles being strip-shaped and two respective reflector profiles being arranged such that the reflector surfaces of the two reflector profiles extend, at least partially, in opposed relationship with one another and the two reflector profiles define a respective reflector pair. The light sources arranged at the back of the first reflector profile will then irradiate light onto the oppositely disposed reflector surface of the second reflector profile and vice versa. Due to the fact that the reflector surfaces are arranged on the reflector profiles and that the apertures in the reflector profiles are configured as reflectors, the luminosity distribution of the entire luminaire as well as the luminous flux concentration of the individual light sources can be realized with only one component. This leads to a substantial reduction of the number of optical components.

According to an advantageous embodiment, each of the reflector profiles can be substantially linear in its longitudinal direction. The reflector profiles thus have a very simple shape, whereby they can be produced easily, e.g. by means of extrusion.

In order to allow the light emitted by the light sources to be directed more effectively, it can be provided that a reflector wedge is arranged between the reflector surfaces of the two reflector profiles.

Yet another embodiment is so conceived that the two reflector profiles are arranged such that they define an angle. This is another possibility of generating the asymmetry of luminosity distribution required for street lightings. The angle between the two reflector profiles is typically an angle between approx. 5° to 10°.

According to yet another variant, it can be provided that the luminaire comprises at least two reflector pairs including each two oppositely disposed reflector profiles, and that the reflector pairs are arranged in succession in the longitudinal direction of the luminaire. Preferably, the two reflector profiles of each reflector pair are arranged such that they define an angle. Hence, the luminaire has a fir-tree-like structure. This has the effect that the lateral dimensions of the luminaire system are reduced.

In addition, the present invention also relates to a reflector profile for an above-described luminaire, said reflector profile being curved in only one plane, and comprising a plurality of apertures for light sources, a reflector surface, and, on a back, at least one connection surface for a light source module. The reflector profile is characterized by a very simple shape and, consequently, it can be manufactured easily and at a reasonable price.

According to one variant of the reflector profile, the apertures can be implemented as reflectors, and the circumferential surfaces of the apertures as well as the reflector surface can be provided with a light-directing layer. Making use of this arrangement, the luminosity distribution of a luminaire as well as the luminous flux concentration of the individual light sources of the luminaire can be realized with only one component, viz. the above-described reflector profile. This leads to a substantial reduction of the number of optical components.

BRIEF DESCRIPTION OF THE DRAWINGS

In the following, the present invention will be described in more detail on the basis of drawings, in which.

DETAILED DESCRIPTION

Figure 1:
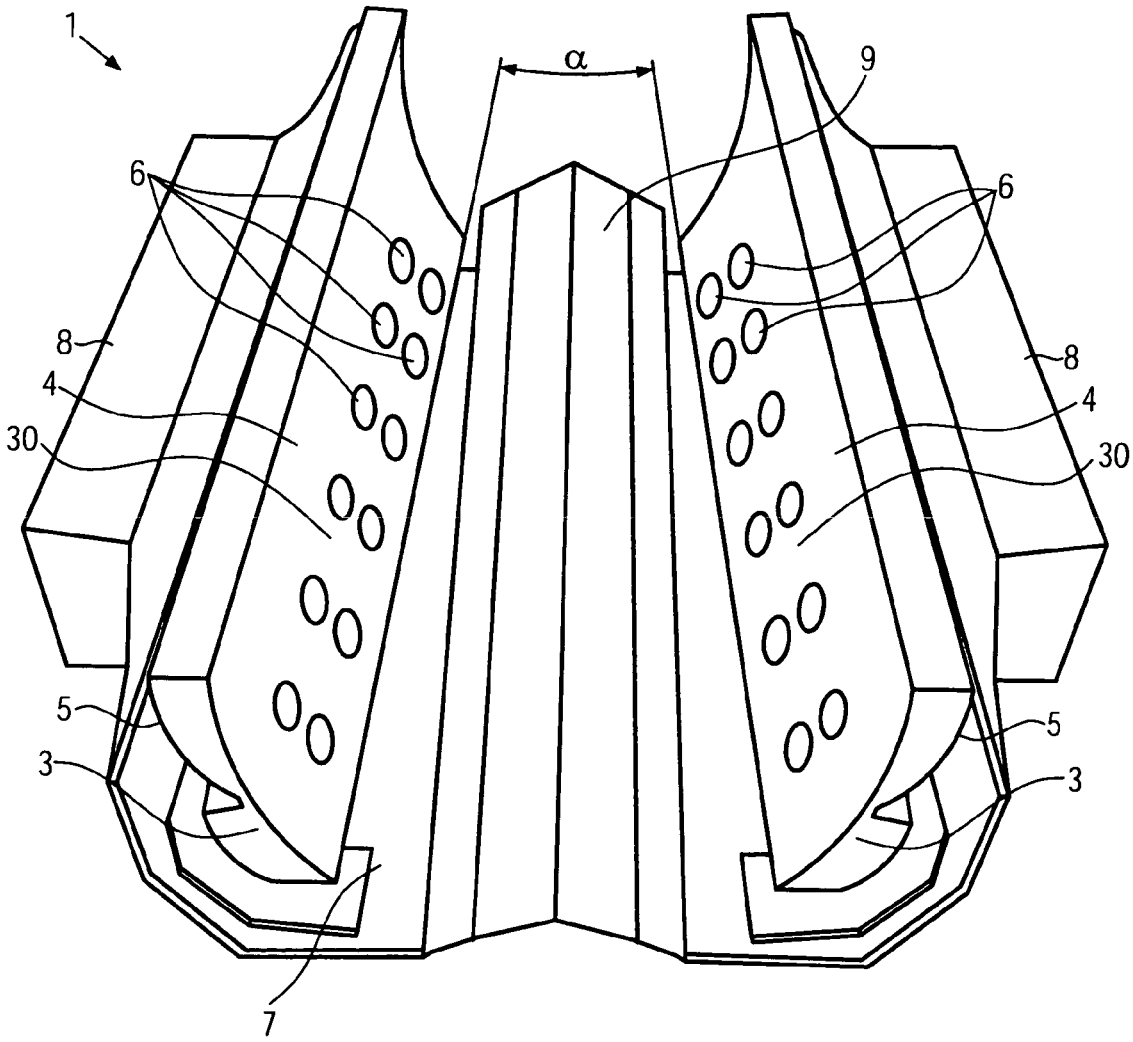
FIG. 1 shows a perspective view of a luminaire from below.

FIG. 1 shows a perspective view of a luminaire 1 from below. The luminaire 1 shown comprises two reflector profiles 3 extending linearly in the longitudinal direction. The two reflector profiles 3 extend, at least partially, in opposed relationship with one another and have an identical structural design. Each reflector profile 3 has a front 30 facing the interior of the luminaire 1 and a back 5 facing away from the front 30. The front 30 of the reflector profiles 3 is configured as a reflector surface 4 at least in certain areas thereof. To this end, the front 30 is provided with light-directing surfaces. The surface of the front 30 of the reflector profiles 3 may, for example, have evaporated thereon reflecting layers so as to form the reflector surfaces 4. It can be provided that the reflector surfaces 4 are slightly roughened, whereby the visible luminance in the luminaire 1 is reduced and the visual comfort increased.

Each of the reflector profiles 3 is provided with a plurality of apertures 6. As can be seen from FIG. 1, each of the reflector profiles 3 comprises two rows of apertures 6 which extend parallel to a base 7 of the luminaire 1.

The back 5 of the reflector profiles 3 is provided with connection surfaces having arranged thereon a plurality of light-emitting light sources in the area of the apertures 6. The light sources arranged on the connection surface of the first reflector profile 3 emit light onto the reflector surface 4 of the second reflector profile 3, and the light sources arranged on the connection surface of the second reflector profile 3 emit light onto the reflector surface 4 of the first reflector profile 3. A plurality of light sources can be combined so as to form a light source module 8. The light sources can preferably consist of light-emitting diodes which are combined so as to form light-emitting diode modules 8. The light-emitting diode modules 8 are wired in common and can be attached to the back 5 of the reflector profiles 3 as a single unit. The light-emitting diodes are arranged behind or inside the apertures 6 so that they will not project beyond the reflector surfaces 4 of the respective reflector profile 3. The light-emitting diode modules 8 are preferably potted and provided with electronic protection means. This allows a limitation of thermal currents. It is also possible to use individual light-emitting diodes instead of the light-emitting diode modules 8. The light-emitting diode modules 8 are, however, much more robust and less expensive and they can be mounted automatically. In addition, light-emitting diode modules 8 can be exchanged easily in the case of repair.

The two reflector profiles 3 of the luminaire 1 are arranged such that they extend at an angle $\alpha$ relative to one another, the reflector surfaces 4 of the two reflector profiles 3 extending at least partially in opposed relationship with one another. The angle $\alpha$ between the two reflector profiles is preferably an angle of approx. 5° to 10°. In the interior of the luminaire 1, a reflector wedge 9 is arranged between the two reflector profiles 3. By means of the reflector wedge 9 the light emitted by the light sources can be oriented more effectively.

Instead of two reflector profiles, the luminaire may also comprise one reflector profile, which is U-shaped in cross-section and which, as has been described hereinbefore, is suitable for accommodating LED modules. This reflector profile may also be configured such that only one of its legs is provided with apertures and that only the second, opposed leg is provided with a reflector surface. This embodiment may also be so conceived that the reflector profile is divided between the legs in the longitudinal direction and is thus defined by two strip-shaped profiles.

Figure 2:
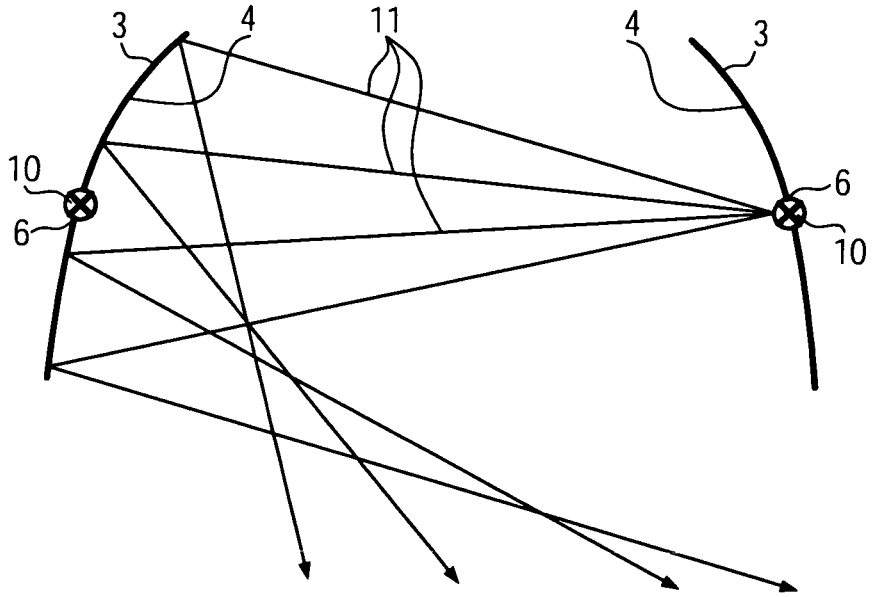
FIG. 2 shows the beam path of the light in the luminaire according to FIG. 1.

FIG. 2 shows the beam path of the light emitted by the light sources 10 in a cross-sectional view of the luminaire 1. For the sake of clarity, only the beam paths 11 of the light emitted by the light source on the right hand side are shown. In this schematic representation, the reflector profiles 3 are only shown in the form of lines. Hence, the reflector profiles 3 coincide with their reflector surfaces 4. The curves or contours of the light-directing reflector surfaces 4 are calculated relative to the position of the apertures 6 in such a way that the light of the respective opposed light sources 10 is deflected in the desired direction in the vertical viewing plane. As has already been described, the light sources 10 are arranged within or behind the apertures 6 of the reflector profiles 3. The light emitted by the light source 10 does not then radiate directly downwards onto the area to be illuminated, but is directed into the horizontal direction, falls on the reflector surface 4 of the opposed reflector profile 3 and is deflected by the reflector surface 4 such that it exits the luminaire 1 and illuminates the desired area.

Figure 3:
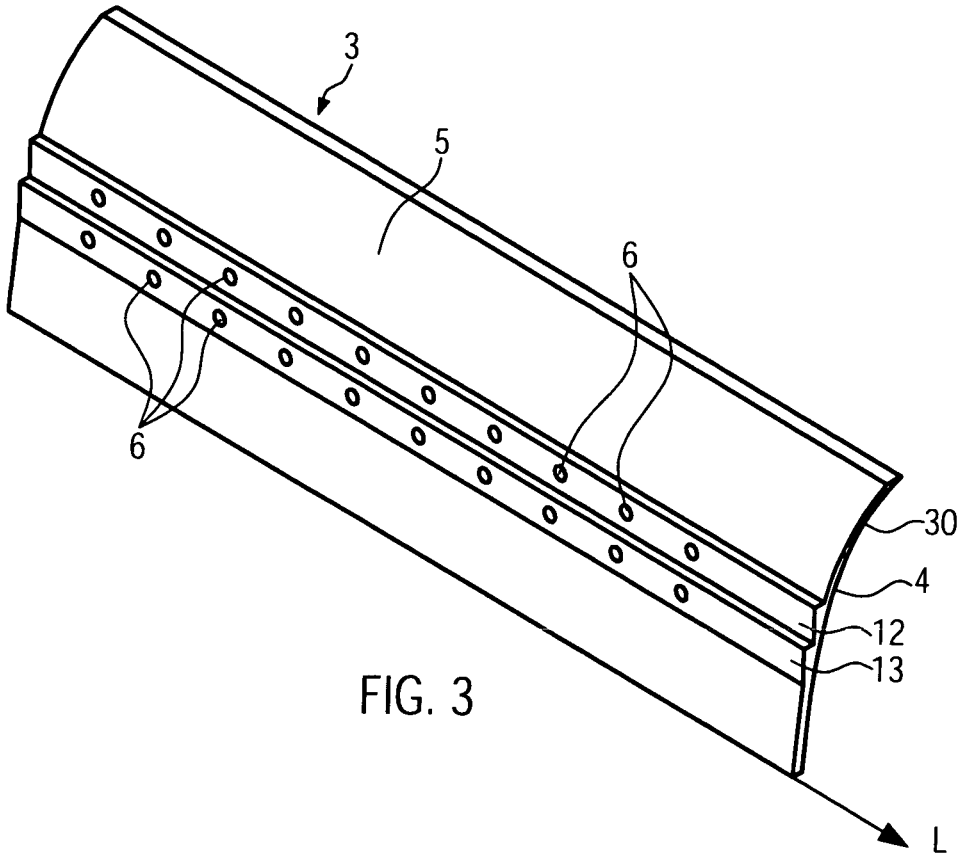
FIG. 3 shows a perspective view of a reflector profile of the luminaire according to FIG. 1 from behind.

FIG. 3 shows a reflector profile 3 for the luminaire 1. As can be seen in FIG. 1, the luminaire 1 may comprise two or more of these reflector profiles 3. The reflector profile 3 extends in the longitudinal direction L and is curved in only one spatial direction, in the present case transversely to the longitudinal direction L of the reflector profile 3. The reflector profile 3 is therefore substantially strip-shaped. The front 30 of the reflector profile 3 is preferably coated with a light-directing material and defines a reflector surface 4. On the back 5, the reflector profile 3 has two connection surfaces 12, 13 for arranging light sources thereon. In FIG. 3, the connection surfaces 12, 13 are configured as two narrow, strip-shaped surfaces having each formed therein a plurality of apertures 6. If the light sources 10 are implemented as light-emitting diodes, each of the connection surfaces 12, 13 can have attached thereto a strip-shaped light-emitting diode module. The luminaire 1 has installed therein at least two of the reflector profiles 3 such that their reflector surfaces 4 extend in opposed relationship with one another.

Figure 4:
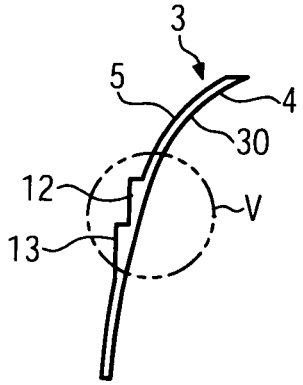
FIG. 4 shows a cross-section of the reflector profile according to FIG. 3 at right angles to its longitudinal direction.

FIG. 4 shows a sectional view of the reflector profile 3 according to FIG. 3 transversely to its longitudinal direction L. On the front 30 of the reflector profile 3, the reflector surface 4 is provided. The reflector surface 4 is provided with a reflecting layer and its contour is configured such that it redirects the incident light, which is emitted by an oppositely disposed light source, into the vertical plane. The cross-section of the reflector surface 4 perpendicularly to the longitudinal direction L is here defined by a continuous curve. The reflector surface 4 has preferably an arcuate cross-section. On the back 5 of the reflector profile 3, the two connection surfaces 12, 13 are provided for attaching the light sources, preferably the light-emitting diode modules. These connection surfaces 12, 13 are flat and allow easy mounting of the light sources. When the reflector profile 3 has been installed in a luminaire 1, the connection surfaces 12, 13 extend substantially at right angles to the base 7 of the luminaire 1.

Figure 5:
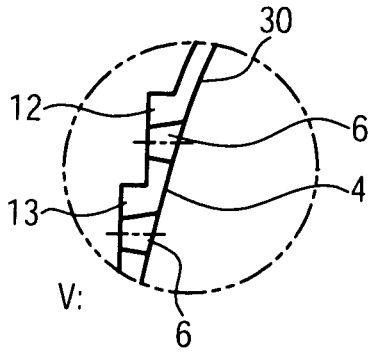
FIG. 5 shows an enlarged representation of detail V according to FIG. 4.

FIG. 5 shows an enlarged representation of detail V according to FIG. 4. In the area of the connection surfaces 12, 13 the apertures 6 are arranged in the reflector profile 3. The apertures 6 extend from the connection surfaces 12, 13 to the reflector surface 4. Said apertures 6 are preferably implemented as conical holes. The light sources or light-emitting diode modules are preferably attached to the connection surfaces 12, 13 such that the light sources are arranged behind the apertures 6 or protrude into said apertures 6, without projecting, however, beyond the reflector surface 4. In order to allow the light emitted by the light sources or light-emitting diodes to be concentrated and directed, the circumferential surfaces of the apertures 6 are also provided with reflecting layers and, consequently, implemented as reflectors.

It is also possible to provide, instead of two spatially displaced, strip-shaped connection surfaces 12, 13, one continuous connection surface for a large-area LED module. A plurality of smaller connection surfaces located in the same plane may, however, be used as well.

Figure 6:
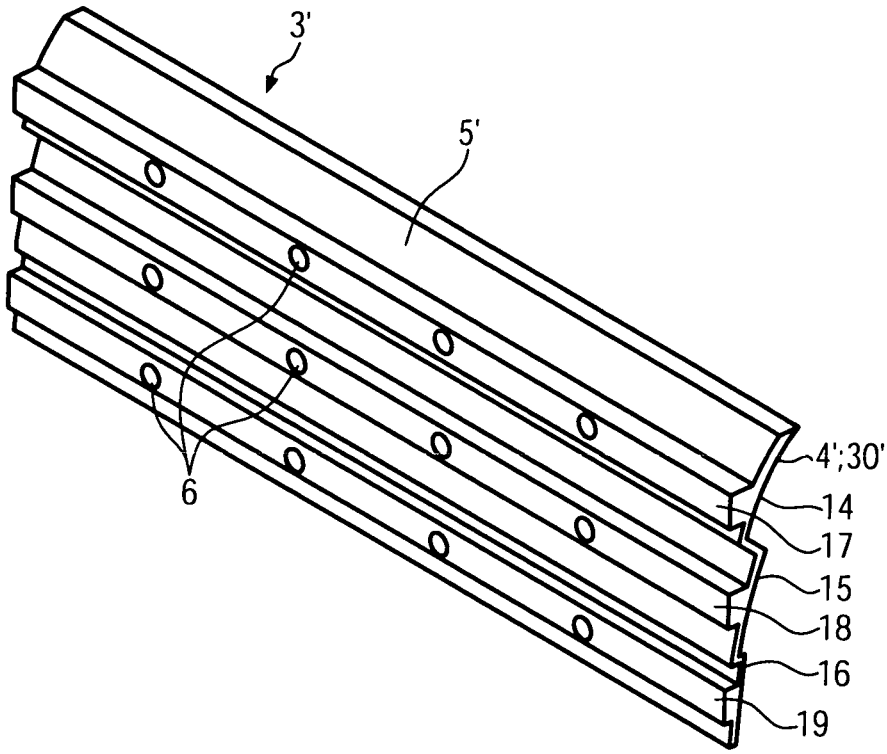
FIG. 6 shows a perspective view of another embodiment of a reflector profile of the luminaire according to FIG. 1 from behind.

FIG. 6 shows a further embodiment of a reflector profile 3' for the luminaire 1. Also in this case, at least two of the reflector profiles 3' are installed in the luminaire 1 such that their reflector surfaces 4' extend, at least partially, in opposed relationship with one another. In the following, only the differences existing with respect to the above-described reflector profile 3 will be shown. The reflector profile 3' differs from the above-described reflector profile 3 insofar as the cross-section of the reflector surface 4' is composed of individual curve segments 14, 15, 16, i.e. the reflector surface 4' is composed of a plurality of surface segments. Also the curve segments 14, 15, 16 are preferably arcuate. According to an advantageous embodiment, the curve segments 14, 15, 16 are configured as a Fresnel structure. This allows the reflector profile 3' to be implemented as a comparatively flat component. The reflector surface 4' is provided with a reflecting layer and its contour is configured such that it redirects the incident light, which is emitted by an oppositely disposed light source, into the vertical plane.

On the reflector-profile back 5', which faces away from the reflector surface 4', each of the curve or surface segments 14, 15, 16 has associated therewith a respective connection surface 17, 18, 19. The apertures 6 are arranged in the area of the connection surfaces 17, 18, 19. Also in this case, the connection surfaces 17, 18, 19 are again implemented as strip-shaped areas. The connection surfaces 17, 18, 19 may, however, also be implemented as a continuous surface. Hence, the reflector profile 3' comprises three rows of apertures 6. The connection surfaces 17, 18, 19 are located in a common plane. When the reflector profiles 3' have been installed in the luminaire 1, this plane extends preferably at right angles to the base 7 of the luminaire 1. Each reflector profile 3' can thus have attached thereto a planar light-emitting diode module.

Figure 7:
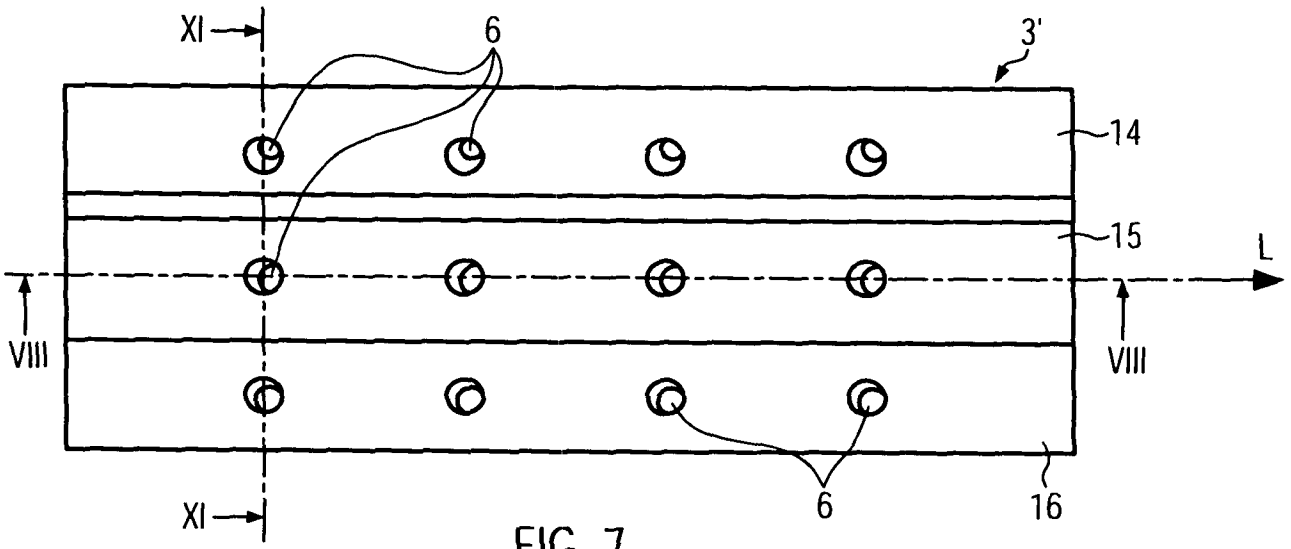
FIG. 7 shows a front view of the reflector profile according to FIG. 6.

FIG. 7 shows a front view of the reflector profile 3' according to FIG. 6. The reflector surface 4' comprising the three curve or surface segments 14, 15, 16 can also be seen in this case.

Figure 8:
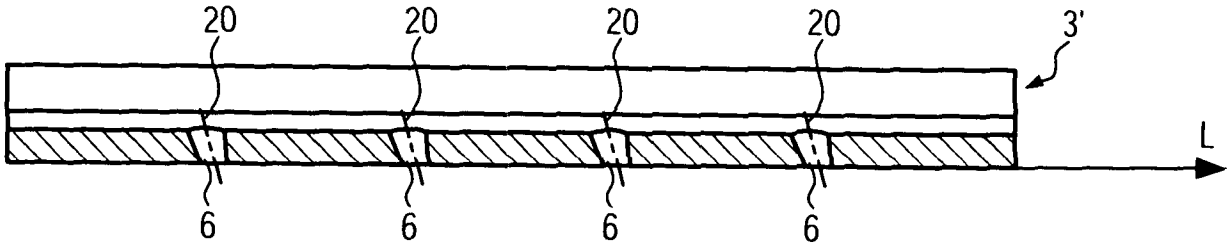
FIG. 8 shows a section through the reflector profile according to FIG. 7 along line VIII-VIII.

Each of the curve or surface segments 14, 15, 16 is provided with a row of apertures 6. The apertures 6 are tilted. This can clearly be seen from the sectional views shown in FIG. 8 and FIG. 9. FIG. 8 shows a section through the reflector profile 3' along the line VIII-VIII according to FIG. 7. Hence, it shows a sectional view parallel to the longitudinal direction L of the reflector profile 3'. The centre axes 20 of the apertures 6 in the central row are inclined in the longitudinal direction L of the reflector profile 3'. Also the centre axes of the apertures in the other two rows can be inclined in the longitudinal direction L of the reflector profile 3'. This inclination is not absolutely necessary, but it will be of advantage when the luminaires are used as street lightings, since in the case of street lightings the luminaires must normally be installed on the roadside or wayside. The luminaires must therefore have an asymmetric luminosity distribution in the horizontal viewing plane. This asymmetric luminosity distribution is accomplished, on the one hand, by the inclination of the apertures 6 in the longitudinal direction L of the reflector profile 3'. In addition, also the fact that the two reflector profiles 3; 3' are arranged in the luminaire 1 such that they extend at an angle $\alpha$ to one another contributes to the necessary asymmetry of luminosity distribution.

Figure 9:
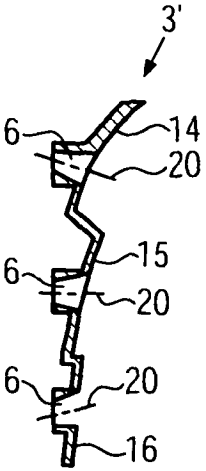
FIG. 9 shows a section through the reflector profile according to FIG. 7 along line IX-IX.

FIG. 9 shows a sectional view of the reflector profile 3' along line IX-IX of FIG. 7. In this direction transversely to the longitudinal axis L of the reflector profile 3', the centre axis 20 of the central row of apertures 6, i.e. of the row of apertures 6 in curve segment 15, is not inclined. The apertures 6 in the upper row, i.e. in curve segment 14, are inclined downwards so that their centre axis 20 is directed downwards. The apertures 6 in the lower row, i.e. in curve segment 16, are inclined upwards so that their centre axis 20 is directed upwards. It follows that the ray beams of the light sources or light-emitting diodes in one column intersect. The apertures 6 are configured such that the light sources or light-emitting diodes of the upper row, i.e. in curve segment 14, illuminate the lower curve segment 16 of the reflector surface of an oppositely disposed reflector profile, and the light sources or light-emitting diodes of the lower row, i.e. in curve segment 16, illuminate the upper curve segment 14 of the reflector surface of an oppositely disposed reflector profile.

Also in the first embodiment of a reflector profile 3 described in FIGS. 3 to 5, the apertures 6 can be arranged in the way described hereinbefore and have an inclination transversely and/or longitudinally to the longitudinal direction L of the reflector profile 3.

Figure 10:
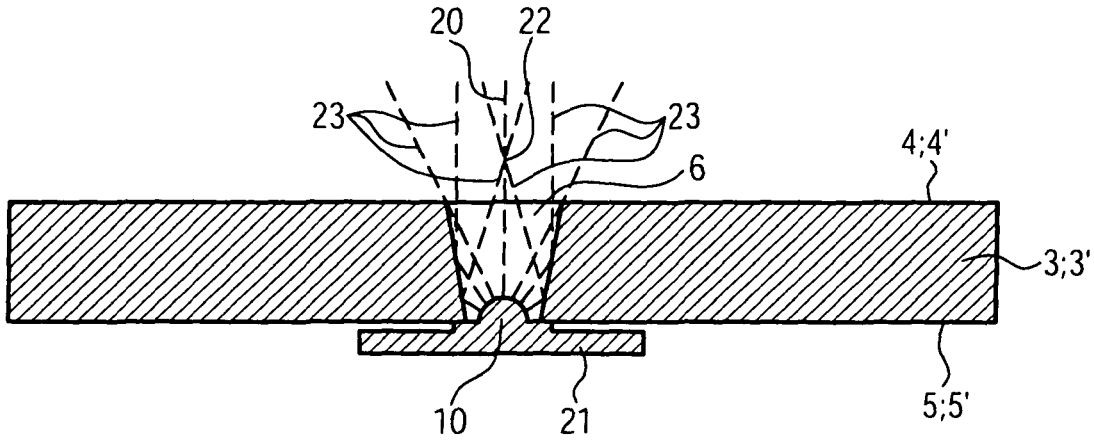
FIG. 10 shows a section through an aperture in a reflector profile of the luminaire according to FIG. 1.

FIG. 10 shows a detail view of an aperture 6 in a reflector profile 3; 3'. The structural design of the reflector profile is not relevant in this case, i.e. the reflector surface 4; 4' of the reflector profile 3; 3' can be configured as a continuous curve or in the form of adjoining curve segments. The aperture 6 extends from a back 5; 5' to the reflector surface 4; 4' of a reflector profile 3; 3'. On the back of the reflector profile 3; 3' a light source 10, preferably a light-emitting diode, is arranged such that the light source 10 is positioned behind or within the aperture 6 and that the light emitted by the light source 10 is radiated through the aperture 6. The light-emitting diode 10 is provided on a carrier board 21. The carrier board 21 is secured in position on the back 5; 5' of the reflector profile 3; 3'. The aperture 6 is implemented as a right circular cone, and its centre axis 20 extends parallel to the centre axis 22 of the light source 10. Since the light source 10 is implemented as a light-emitting diode, its centre axis 22 corresponds to the surface normal on the carrier board 21 of the light-emitting diode. Since the carrier board 21 is in planar contact with the connection surface of the reflector profile, the centre axis 20 of the aperture 6 extends also parallel to the surface normal on the connection surface of the reflector profile.

The surface of the conical aperture 6 has evaporated thereon a highly reflective layer. This layer is preferably smooth and/or highly glossy. Hence, each aperture 6 acts as a concentrating reflector for the light source or light-emitting diode 10 arranged within or behind said aperture. The aperture 6 and the respective light source 10 therefore define a very small spotlight. The light of the light source 10 is thus concentrated onto the respective oppositely disposed reflector surface 4; 4'. The beam path 23 can be seen in FIG. 10. As shown in FIG. 10, a concentrating, symmetric beam path 23 is achieved by means of a conical aperture 6 whose centre axis 20 extends parallel to the surface normal 22 of the light-emitting-diode carrier board 21.

Figure 11:
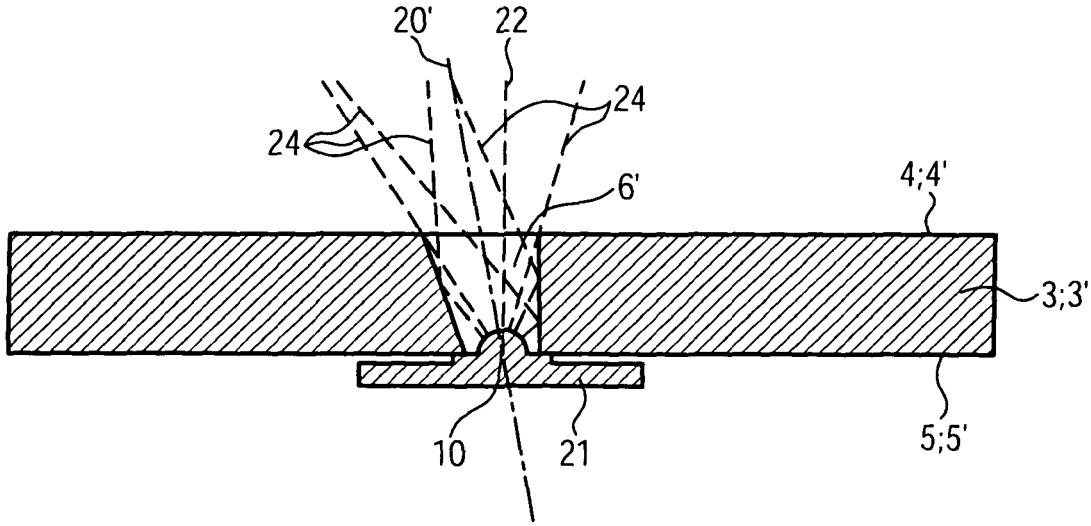
FIG. 11 shows a section through another embodiment of an aperture in a reflector profile of the luminaire according to FIG. 1.

Another structural design of an aperture 6' is shown in FIG. 11. Also in this case, only the differences will be described hereinbelow. The aperture 6' is again conical in shape, but is now configured as an oblique circular cone. The centre axis 20' of the conical aperture 6' is therefore inclined relative to the centre axis 22 of the light source 10 and relative to the surface normal of the carrier board 21 of a light-emitting diode. The centre axis 20' of the conical aperture 6' can be inclined in the longitudinal direction L of the reflector profile 3 and/or transversely to the longitudinal direction L of the reflector profile 3. Hence, the centre axis 20' defines an angle of less than 90° with the connection surface of the reflector profile. This results in the formation of an asymmetric beam path, as shown by the light rays 24 in FIG. 11. It is here not necessary to tilt the light source or light-emitting diode, nor is it necessary to provide ancillary optics.

The apertures 6, 6' are preferably produced as holes, e.g. conical holes. In addition to a conical shape, other profiles for the apertures are, however, imaginable as well. The apertures may, for example, have a circumferential surface that is, at least in certain areas thereof, parabolic. The apertures can then be produced by drilling with a profile drill. Instead of profile drilling, also profile milling may be executed. It is thus possible to generate more complex luminosity distributions of the individual light sources or light-emitting diodes.

Figure 12:
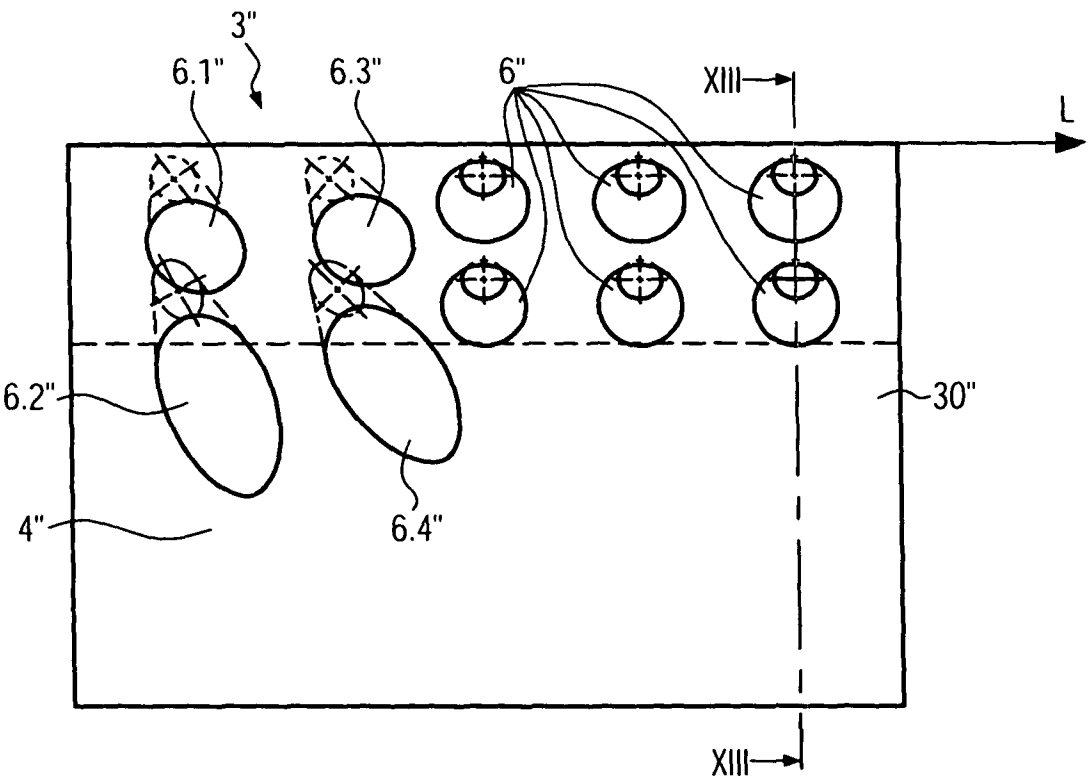
FIG. 12 shows a front view of yet another embodiment of a reflector profile.

Yet another embodiment of a reflector profile 3" is shown in FIG. 12. The reflector profile 3" essentially corresponds to the reflector profiles that have already been described. Also this reflector profile 3" extends again in a longitudinal direction L. As has already been described, the front 30" of the reflector profile 3" is, at least partially, configured as a reflector surface 4" also in this case. Also this reflector profile 3" is provided with apertures within which or behind which light sources can be arranged. As can be seen from FIG. 12, the reflector profile 3" comprises tow rows including each five apertures 6"; 6.1"; 6.2"; 6.3"; 6.4". The apertures 6"; 6.1"; 6.2"; 6.3"; 6.4" have different structural designs. The apertures 6" have the shape of right circular cones. The apertures 6.1"; 6.2"; 6.3"; 6.4", which are shown on the left hand side of FIG. 12, are configured as oblique circular cones. The centre axes of these four apertures 6.1"; 6.2"; 6.3"; 6.4" are inclined in the longitudinal direction L of the reflector profile 3" as well as transversely to the longitudinal direction L of the reflector profile 3". The inclination of the centre axes may be different in the case of each of the apertures 6.1"; 6.2"; 6.3"; 6.4".

Figure 13:
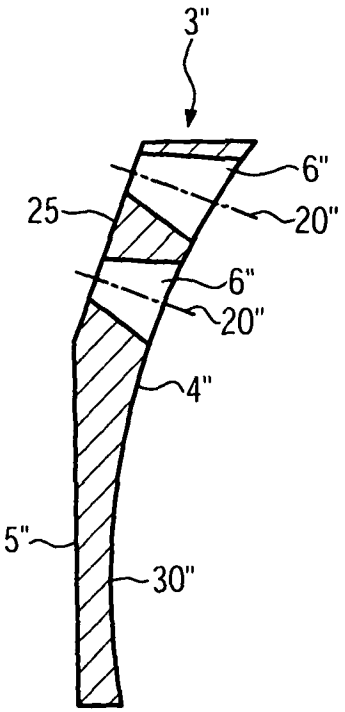
FIG. 13 shows a cross-section through the reflector profile according to FIG. 12 at right angles to its longitudinal direction.

FIG. 13 shows a cross-section through the reflector profile 3" transversely to its longitudinal direction L along line XIII-XIII. The front 30" of the reflector profile 3" is, at least partially, configured as a reflector surface 4". On the back 5" of the reflector system 3" a connection surface 25 for mounting the light-emitting diode modules is provided. The apertures 6" extend from the connection surface 25 through the reflector profile 3" to the front 30".

In the hitherto described embodiments of the reflector profiles 3, 3' the connection surfaces for the light source modules or light-emitting diode modules extend such that, in the installed condition of the reflector profiles in the luminaire, they are arranged substantially perpendicularly to the base 7 of the luminaire. In FIG. 13 it can be seen that the connection surface 25 extends at an oblique angle to the base 7 and defines thus an angle <90° with the base 7, when installed in the luminaire 1. It follows that also the light source modules or light-emitting diode modules can already be mounted obliquely on the reflector profile 3". The centre axes 20" of the apertures 6" define a right angle with the connection surface 25.

Figure 14:
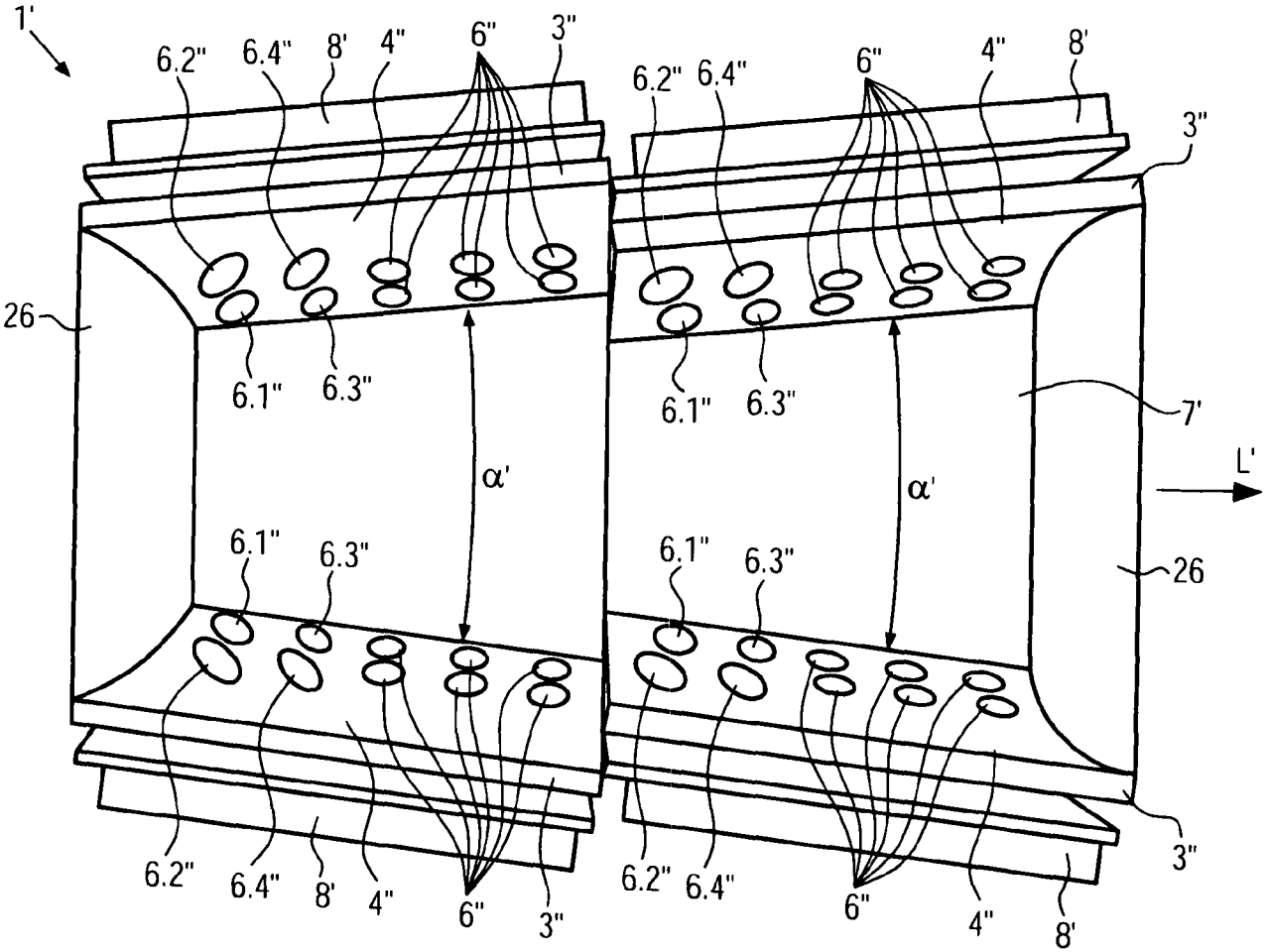
FIG. 14 shows a perspective view of another embodiment of the luminaire from below.

FIG. 14 shows a luminaire 1' in which the reflector profiles 3" have been installed. The luminaire 1' comprises four such reflector profiles 3". Two respective ones of these reflector profiles 3" are arranged in opposed relationship with one another so that their reflector surfaces 4" extend, at least partially, in opposed relationship with one another. Just as in the case of the above-described embodiments, the reflector surfaces 4" are calculated such that the light of the light sources or light-emitting diodes is deflected in the desired direction in the vertical viewing plane. It follows that two respective opposed reflector profiles 3" define a reflector pair. The two reflector pairs are arranged in succession in the longitudinal direction L' of the luminaire 1'. Also in this embodiment, the reflector profiles 3" of each reflector pair are arranged such that they define an angle $\alpha'$ with one another. The angle $\alpha'$ is preferably an angle between 5° and 10°. The arrangement of a plurality of reflector pairs in succession thus leads to a luminaire 1' with reduced lateral dimensions. As has already been described with respect to FIG. 12, each reflector profile 3 comprises two rows of apertures 6"; 6.1"; 6.2"; 6.3"; 6.4". The apertures 6"; 6.1"; 6.2"; 6.3"; 6.4" of each reflector profile 3" can have different structural designs. In the present case, the six apertures 6" provided in the part on the right hand side of the reflector profiles 3" are configured as right circular cones, i.e. the centre axes 20" of the apertures 6" extend perpendicularly to the connection surface 25. The two left apertures 6.1"; 6.3" of the lower row and the two left apertures 6.2"; 6.4" of the upper row are, however, configured as oblique circular cones, i.e. the centre axes of these apertures define an angle of less than 90° with the connection surface 25 of the reflector profile 3" in the longitudinal direction L of the reflector profile 3" or transversely thereto. In this way, an asymmetric luminosity distribution of the luminaire 1' is accomplished, this kind of luminosity distribution being especially desired in the case of street lightings. The base 7' of the luminaire 1' has a planar configuration. It is, however, also imaginable to provide on the base 7' a reflector wedge, as has been described with respect to the first embodiment of the luminaire 1. The luminaire 1' is closed by reflector plates 26 on both ends thereof.

The connection surfaces 25 of the reflector profiles 3" have each attached thereto a light source module or a light-emitting diode module 8'. Since the connection surfaces 25 of the reflector profiles 3" are configured as planes, the light source or light-emitting diode modules can be attached very easily. As can clearly be seen from FIG. 14, each of the reflector profiles 3" can have attached thereto ten light sources or light-emitting diodes. The light-emitting diodes used have preferably a power of 1 watt each. The overall delivery rate of the luminaire 1' is therefore 40 watt. Hence, the luminaire 1' has a gross luminous flux of approx. 3,500 to 4,000 lumina.

In view of the fact that the reflector profiles each comprise a reflector surface as well as apertures used for the light sources and implemented as reflectors, the luminosity distribution of the entire luminaire as well as the luminous flux concentration of the individual light sources or light-emitting diodes can be realized with only one component. This leads to a substantial reduction of the number of optical components required. The connection surfaces provided at the back of the reflector profiles allow very easy mounting of the light source modules or light-emitting diode modules. The necessary number of components is reduced and the structural complexity decreases substantially. This also leads to a reduction of the manufacturing outlay and of the resultant manufacturing cost. Since the light sources or light-emitting diodes are arranged behind or within the apertures, the light emitted is not irradiated directly onto the surface to be illuminated, but redirected onto this surface by the reflector surfaces of the reflector profiles. This leads to a reduction of the visible luminance in the luminaire, an effect which can even be intensified by slightly roughening the reflector surfaces. The visual comfort is increased in this way. Since it is not necessary to use ancillary optics, a high efficiency of the optical operational system can be achieved.

Since the reflector profiles used have a linear character in an essential direction, i.e. a substantially straight configuration in their longitudinal direction, they can be produced very easily. The reflector profiles can e.g. be produced by extrusion of a light-directing curve profile. They can, however, also be produced by die casting or injection moulding. The material used for the reflector profiles is preferably aluminum or a plastic material. The aluminum or plastic profiles have evaporated thereon reflecting layers so as to produce the reflector surface. Prior to the evaporation, the apertures are produced in the aluminum or plastic profiles, so that also the circumferential surfaces of the apertures will be provided with the reflecting layer. On the back of the reflector profiles, linear or planar connection surfaces are provided for attaching thereto the light sources or light-emitting diodes. These connection surfaces allow the use of prefabricated linear or planar light-emitting diode modules. Also this leads to a reduction of the manufacturing outlay and of the resultant manufacturing cost.

The invention claimed is:

1. A luminaire, comprising:

a plurality of light-emitting diodes;

a first reflector profile extending in the longitudinal direction and comprising a plurality of apertures and at least one reflector surface provided on the front of the first reflector profile, wherein light-emitting diodes are arranged in the area of the apertures at the back of the first reflector profile such that the light-emitting diodes do not project beyond the reflector surface of the first reflector profile;

a second reflector profile having a plurality of apertures and at least one reflector surface, wherein light emitting diodes are arranged in the area of the apertures, wherein each of the first and second reflector profiles are strip-shaped, the two respective reflector profiles being arranged such that the reflector surfaces of the two reflector profiles extend, at least partially, in opposed relationship with one another and the two reflector profiles define a respective reflector pair so that the light emitted by the light-emitting diodes is irradiated onto the respective oppositely disposed reflector surface and redirected at said reflector surface onto the surface to be illuminated, wherein each of the first and second reflector profiles is curved in only one plane, the apertures are conical or parabolic in shape, and, on a back, is a connection surface for attaching thereto a light source module, and wherein each of the reflector surfaces is formed by at least one arcuate curve segment in a direction transversely to the longitudinal direction of the respective reflector profile, the apertures are implemented as reflectors, and the circumferential surfaces of the apertures and the reflector surfaces are provided with a light-directing layer.

2. A luminaire according to claim 1, wherein a plurality of light-emitting diodes are combined so as to form the light source module, and wherein light source modules are arranged on the connection surfaces on the back of each of the reflector profiles.

3. A luminaire according to claim 1, wherein a centre axis of at least one aperture extends parallel to a centre axis of the light-emitting diodes associated with said aperture.

4. A luminaire according to claim 1, wherein a centre axis of at least one aperture defines an angle with a centre axis of the light-emitting diodes associated with said aperture, so that the centre axis of the aperture is inclined in the longitudinal direction of, and/or transversely to, the longitudinal direction of the reflector profile.

5. A luminaire according to claim 1, wherein the cross-section of the reflector surface at right angles to the longitudinal axis of the reflector profile is defined by a continuous curve.

6. A luminaire according to claim 1, wherein the cross-section of the reflector surface at right angles to the longitudinal axis of the reflector profile is defined by a plurality of adjoining curve segments.

7. A luminaire according claim 1, wherein each of the reflector profiles is substantially linear in its longitudinal direction.

8. A luminaire according to claim 1, wherein a reflector wedge is arranged between the reflector surfaces of the two reflector profiles.

9. A luminaire according to claim 1, wherein the two reflector profiles are arranged such that they define an angle.

10. A luminaire according to claim 1, further comprising at least two reflector pairs each including two oppositely disposed reflector profiles, and wherein the reflector pairs are arranged in succession in the longitudinal direction of the luminaire.

* * * * *